US008975498B2

(12) United States Patent
Mullins

(10) Patent No.: US 8,975,498 B2
(45) Date of Patent: Mar. 10, 2015

(54) MUSICAL INSTRUMENT SHOULDER STRAP SUPPORT

(71) Applicant: Timothy Dennis Mullins, Santa Barbara, CA (US)

(72) Inventor: Timothy Dennis Mullins, Santa Barbara, CA (US)

( * ) Notice: Subject to any disclaimer, the term of this patent is extended or adjusted under 35 U.S.C. 154(b) by 40 days.

(21) Appl. No.: 13/972,733

(22) Filed: Aug. 21, 2013

(65) Prior Publication Data

US 2014/0190331 A1 Jul. 10, 2014

Related U.S. Application Data

(60) Provisional application No. 61/750,907, filed on Jan. 10, 2013.

(51) Int. Cl.
*G10D 3/00* (2006.01)
*G10G 5/00* (2006.01)

(52) U.S. Cl.
CPC ..... *G10G 5/005* (2013.01)
USPC ..... 84/327

(58) Field of Classification Search
CPC ..... G10G 5/0005; G10G 7/005; G10D 3/003
USPC ..... 84/327, 329
See application file for complete search history.

(56) References Cited

U.S. PATENT DOCUMENTS 6,359,203 B1 * 3/2002 Cronos ..... 84/327

* cited by examiner

*Primary Examiner* — Kimberly Lockett

(57) ABSTRACT

A device and method of supporting a stringed musical instrument such as a ukulele or guitar in a stable hands-free playing position on the user by means of a shoulder strap comprising a single adjustable closed loop including a one-half twist which follows a specific novel path under the strings and about the instrument and the user's body.

1 Claim, 4 Drawing Sheets

MUSICAL INSTRUMENT SHOULDER STRAP SUPPORT

The current application claims a priority to the U.S. Provisional Patent Application No. 61/750,907 filed on Jan. 10, 2013.

BACKGROUND OF THE INVENTION

The ukulele has traditionally been played without the use of a strap by cradling the instrument against the players body with the strumming forearm while supporting the neck of the instrument with the fretting hand. Many players of the ukulele would prefer to have their instruments fully supported while playing, which would allow free use of either hand for any playing technique.

Traditionally, ukuleles are constructed without end pins or strap buttons with which to attach a strap. Many players do not wish to modify their instruments with screw-mounted end pins or strap buttons, which have drawbacks such as the possibility of damaging the instruments in their installation, or of devaluing them by altering their originality.

Other devices intended to support the instrument which do not require its modification, such as peg head attachment straps or sound hole hook straps, do not fully support the ukulele in playing position and require the use of at least one hand or arm to restrain the instrument.

The present invention supports a ukulele in playing position without the use of hands or arms and without the need for modification of the instrument.

BRIEF SUMMARY OF THE INVENTION

The present invention follows a specific novel path when in use unlike that of other supporting methods. In use, the present invention comprises an adjustable single closed strap loop which encircles the ukulele body beneath the strings and cradles it beneath the narrow waist area, proceeds up across the back of the ukulele and the player's chest and encircles the player's body over the shoulder to the same side as the neck of the ukulele. It then continues diagonally down and across the player's back and underneath the opposite armpit, emerging to pass over the top of the ukulele's lower bout and completing the loop at the face of the instrument. The present invention following this specific novel path has the effect of holding the body of the ukulele up on the bottom at the waist and down on the top at the lower bout, counterbalancing the weight of the ukulele neck to achieve a stable configuration.

This specific novel path results in an apparent one-half twist in the strap due to the relationship between the strap, the ukulele and the player's body. By positioning the hook and loop fastener strips to make their mutual attachment to close the loop possible only when the strap includes a one-half twist, the apparent twist in use can be cancelled out by use of a countervailing one-half twist.

These two concepts, the specific novel path of the strap about the instrument and player and the one-half twisting adjustable closed loop configuration of the strap are the basic elements of the present invention.

BRIEF DESCRIPTION OF THE SEVERAL VIEWS OF THE DRAWING

All drawings are for the purpose of describing selected versions of the present invention and are not intended to limit the scope of the present invention.

DETAILED DESCRIPTION OF THE INVENTION

Figure 1:
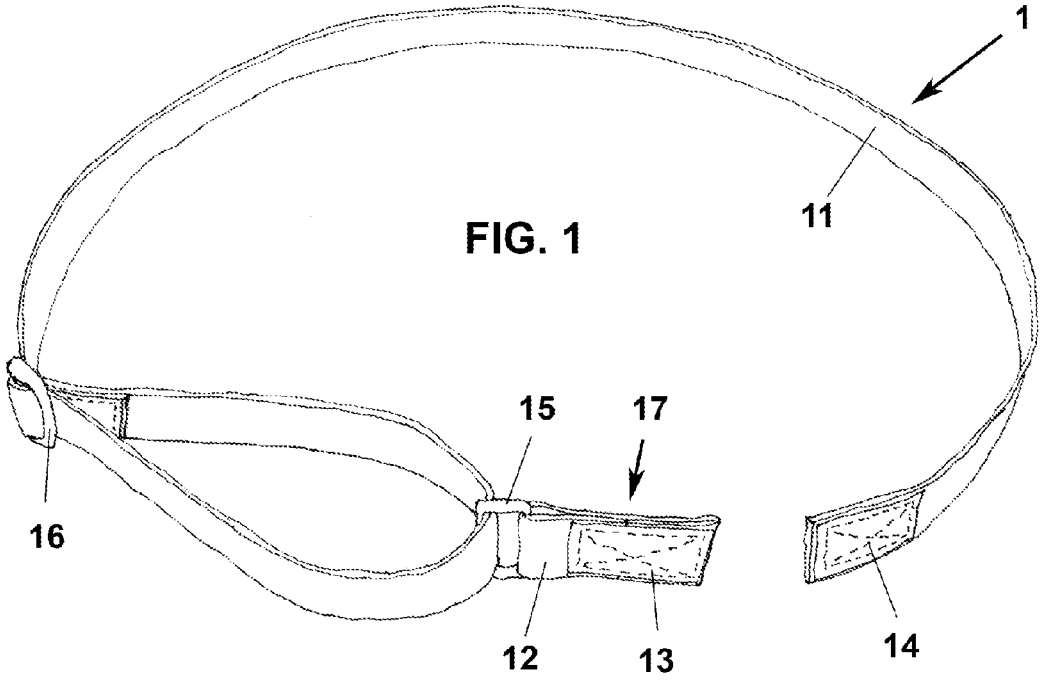
FIG. 1 is a perspective view of the present invention and the components thereof.

The components of the preferred embodiment of the present invention 1 are assembled as follows:

In reference to FIG. 1, The connection loop 15 and the hook fastener strip 13 are affixed to the secondary strap 12. This assembly will hereinafter be referred to as the connection tab 17.

Figure 2:
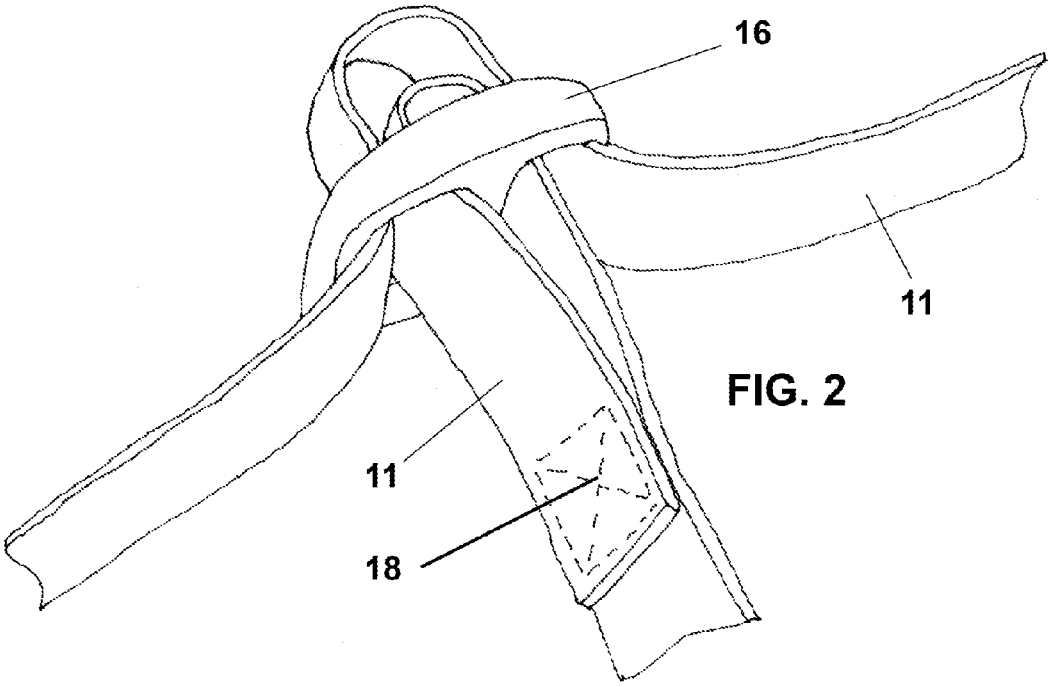
FIG. 2 is a detail view of the mounting and the sewn attachment of the main strap to the length adjustment slide.

In reference to FIG. 1-2, the length adjustment slide 16 is affixed to one end of the main strap 11 at location 18 and the loop fastener strip 14 is affixed to the opposite end.

In reference to FIG. 1, the main strap 11 is threaded through the connection loop 15 of the connection tab 17 and through the length adjustment slide 16, connecting the main strap 11 and the connection tab 17 such that the hook fastener strip 14 and the loop fastener strip 13 are aligned in the same orientation.

The preferred embodiment of the present invention 1 is used and operated as follows:

In reference to FIG. 3-8, the descriptions below use a right-handed player as an example.

Figure 3:
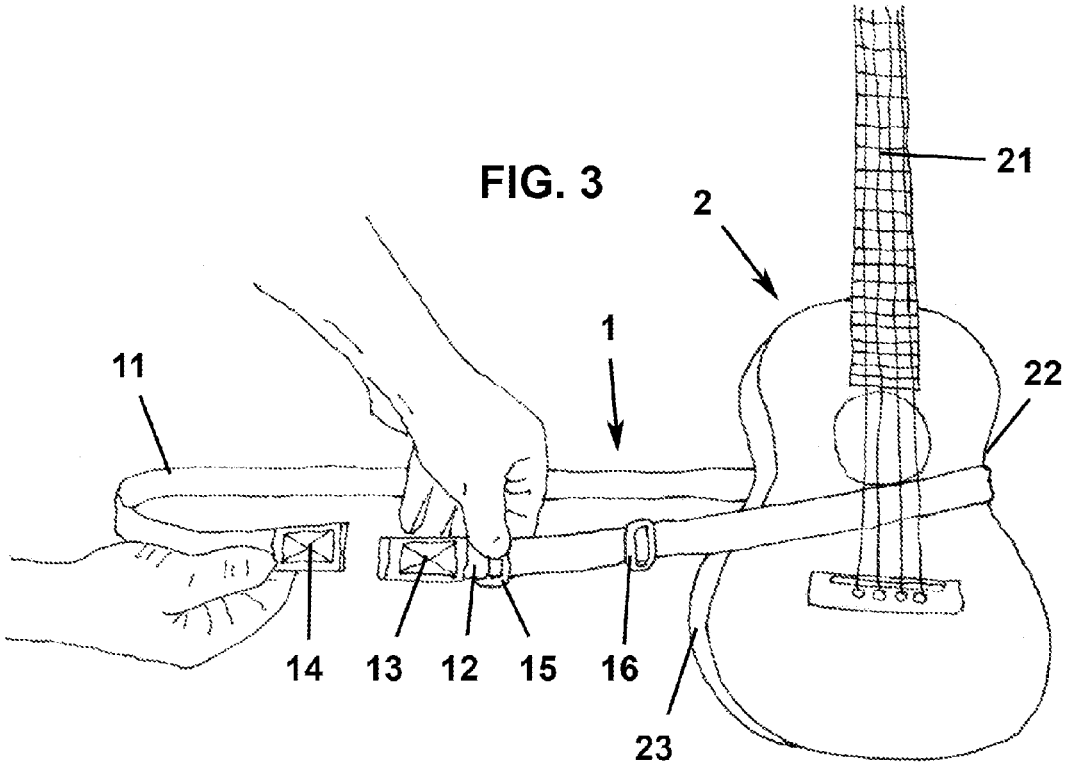
FIG. 3 is a perspective view of the present invention threaded underneath the strings of the ukulele to form a loop with the two ends being held in opposition and with the mating hook and loop fastener strips aligned in the same orientation.

In reference to FIG. 3, the ukulele 2 is placed on its back with its neck 21 to the left of its body. The end of the main strap 11 with the loop fastener strip 14 attached is fed away from the player under the strings of the ukulele 2 to circle underneath the ukulele body and to then be brought up to meet the trailing connection tab 17 to complete a loop, with no twists in the main strap 11.

Figure 4:
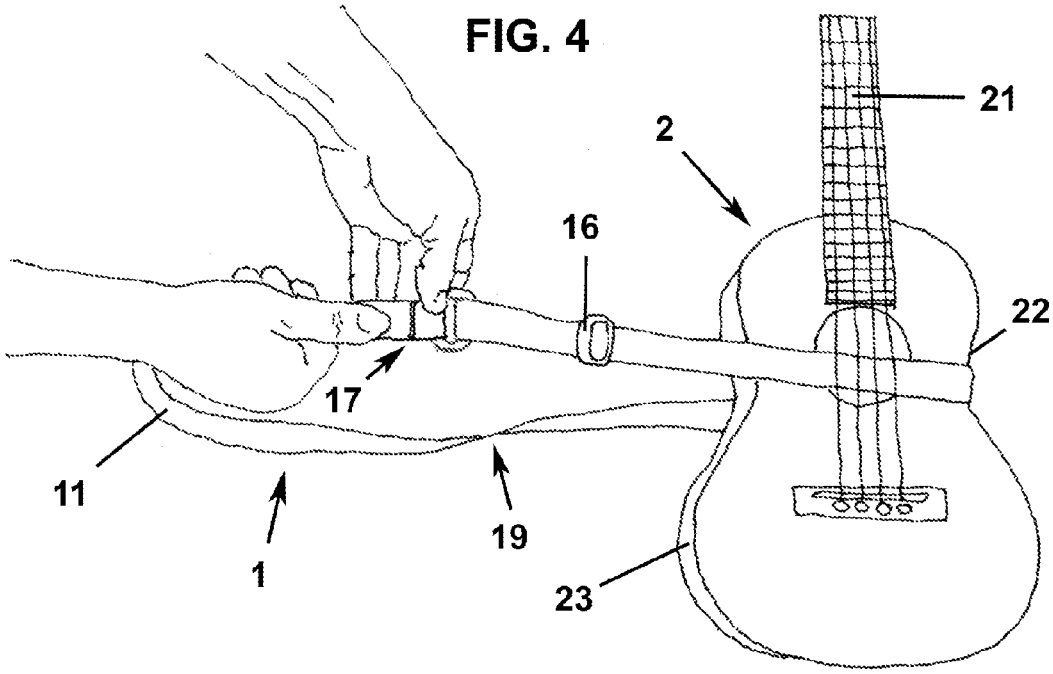
FIG. 4 is a perspective view of the present invention showing the end of the strap having been turned over to engage the hook and loop fastener strips, resulting in a closed loop incorporating a one-half twist.

In reference to FIG. 4, the end of the main strap 11 with the loop fastener strip 14 attached is then turned over to the right so that the hook fastener strip 13 and the loop fastener strip 14 are facing each other and then overlapped and pressed together so they engage and adhere to each other. The present invention 1 now comprises a loop encircling the ukulele 2 underneath its strings with a one-half twist 19 in the main strap 11.

Figure 5:
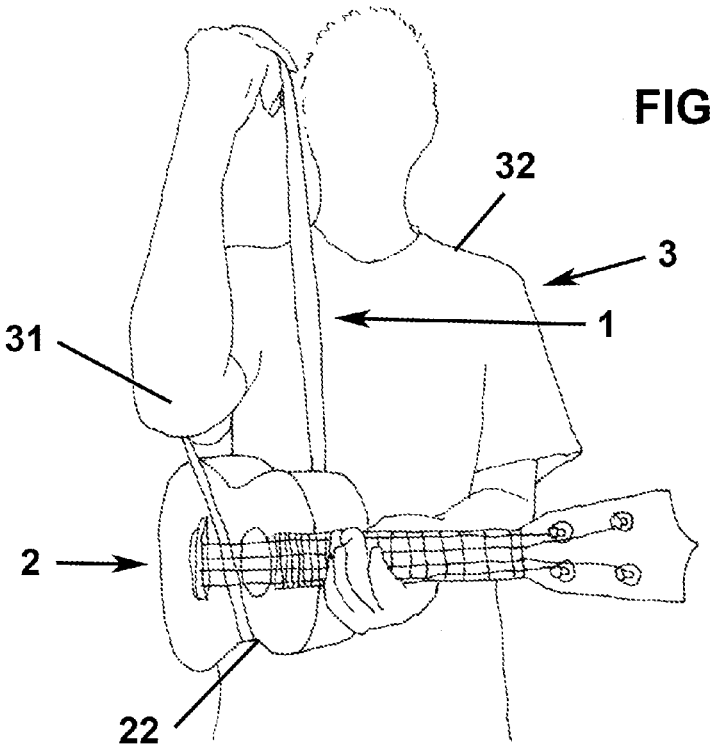
FIG. 5 is an elevation view of the player supporting the ukulele with the left hand while lifting the present invention with the right hand and putting the right elbow through the opening above the ukulele body.

In reference to FIG. 5, the ukulele 2 is held in the left hand of the player 3 with the present invention 1 encircling the body of the instrument under the strings at the waist 22. The present invention 1 is raised with the player's right hand and the player's right elbow 31 is placed toward the instrument's neck 21 through the opening formed by the present invention 1 above the ukulele body.

Figure 6:
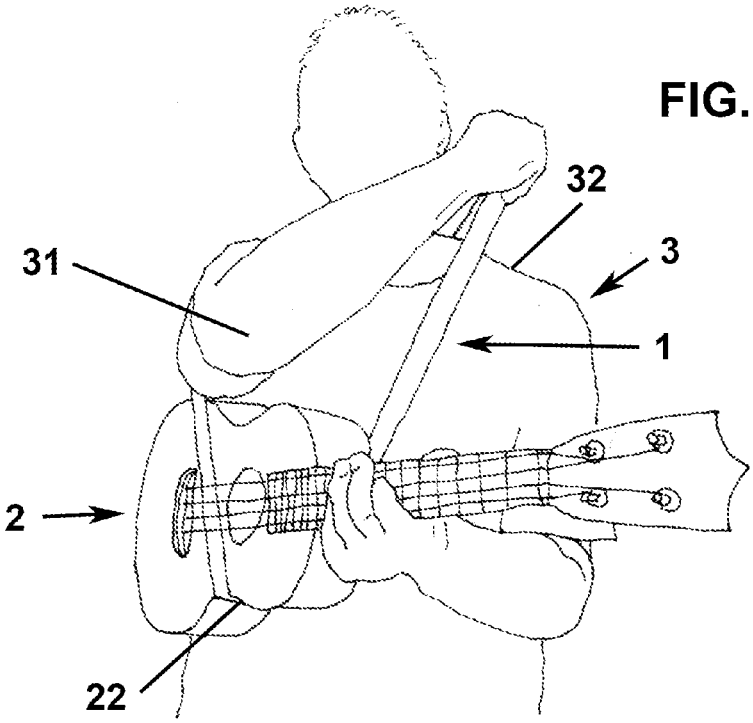
FIG. 6 is an elevation view of the present invention having been lifted over the player's head to be placed on the left shoulder.

In reference to FIG. 6, the present invention 1 is continued to be raised with the player's right hand, brought over the player's head and lowered to rest on the left shoulder 32.

Figure 7:
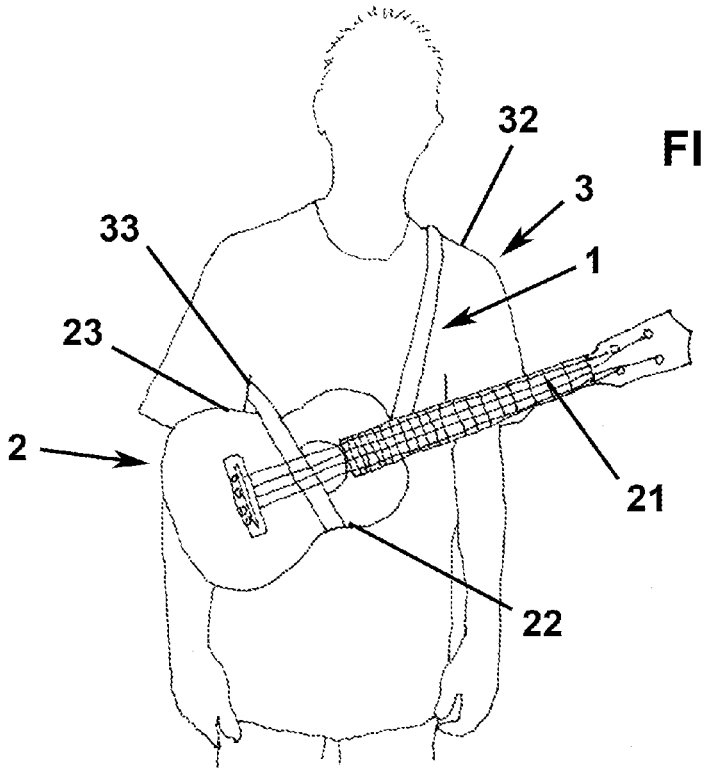
FIG. 7 is a front elevation view of the present invention in use supporting the ukulele on the player.
Figure 8:
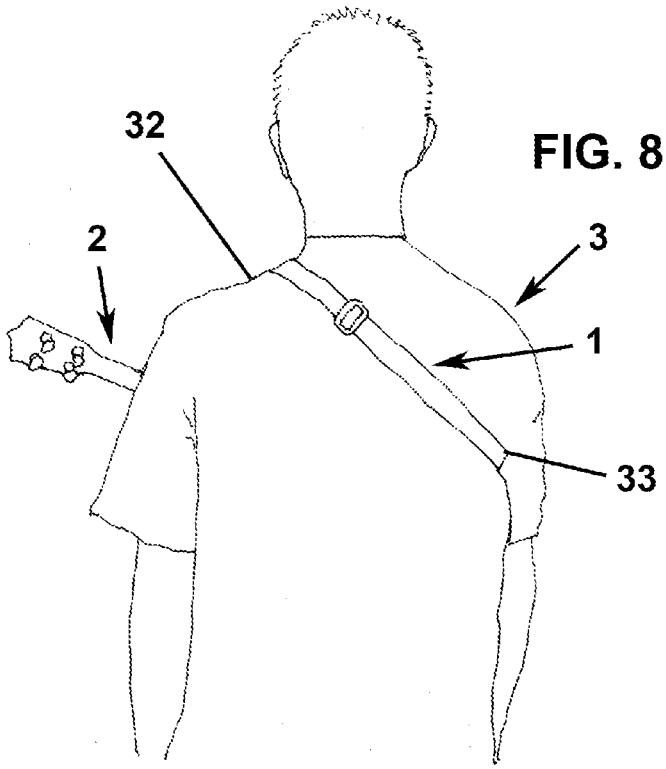
FIG. 8 is a rear elevation view of the present invention in use supporting the ukulele on the player.

In reference to FIG. 7-8, the loop formed by the present invention 1 has thus been placed on the torso of the player 3 following a specific novel path which proceeds from a starting point under the strings down across the front surface of the ukulele 2; across its lower side surface at the waist 22; up across its back surface; up the player's chest and over the left shoulder 32; diagonally down across the player's back to go under the right armpit 33; forward over the top side surface of the instrument at the lower bout 23 and down across its front surface to the starting point. When properly adjusted by use of the length adjustment slide 16, the present invention 1 leverages the lower waist 22 of the instrument up and holds the upper side of the lower bout 23 down, counterbalancing the weight of the instrument's neck 21. The present invention thus supports a ukulele in playing position without the use of hands or arms and without the need for modification of the instrument.

In reference to FIG. 7-8, the specific novel path of the present invention 1 when worn requires an opposite one-half twist 19 in order to lay flat across the ukulele 2 and player 3. This can be illustrated by tracing an imaginary line along the center of the flat surface of the present invention 1: Beginning under the strings on the front of the instrument 2, said line runs on the outside surface of the present invention 1 down over the waist 22 and up the back of the instrument 2. Continuing up, the line transitions to run on the underside of the present invention 1 over the player's shoulder 32, diagonally down across the player's back and under the player's other armpit 33 and, still underneath, runs over the side of the instrument's lower bout 23. The line continues to run underneath down across the face of the instrument 2 to its starting point under the strings, but now on the opposite surface of the present invention 1. If the present invention 1 were constructed without the one-half twist 19 it would still securely support the instrument 2 in playing position, but there would appear to be a half-twist when worn by the player 3. By adding an opposite half-twist 19, this effect is neutralized and the present invention 1 will lay flat across all surfaces of the instrument 2 and the body of the player 3 when in use.

Although the present invention has been explained in relation to its preferred embodiment, it is to be understood that many other possible modifications and variations can be made without departing from the spirit and scope of the present invention.

The present invention may be constructed in alternate ways as follows:

The straps of the present invention could be made in different lengths to accommodate different instrument sizes or player body sizes.

The straps of the present invention could be made in different widths for strength or player comfort.

The straps of the present invention could be made of other materials such as leather, nylon webbing or fabric.

The hook and loop fastener strips of the present invention could be made in different sizes sufficient to securely support the instrument.

The positions of the hook fastener strip and of the loop fastener strip could be reversed with each other.

The connection made by the hook and loop fastener strips could be made by other means such as quick-release plastic buckles, snaps or laces.

The present invention may be used in alternate ways as follows:

The present invention could also be used on tenor, classical or flamenco guitars.

The present invention can be used by left-handed players by mirror-image reversal of the instructions for right-handed players given above.

If the strap of the present invention is twisted one-half turn in the incorrect direction the strap will still securely support the instrument, but will appear to have a full twist in it when worn.

I claim:

1. A musical instrument shoulder strap support comprising:

a strap support, for use on a stringed musical instrument which has an elongated body portion with a narrowed waist and a neck portion, such as a ukulele or guitar;

a means for fastening the two ends of said strap support together to form a single closed loop;

a means to selectively adjust the length of said closed loop, said length being sufficient to engage both the player and said instrument;

a specific novel path of said closed loop, proceeding under the strings and about said instrument and said player;

a main strap, one end of which is affixed to a length adjustment slide and the side surface of the opposite end of which is affixed to a loop fastener strip;

a connection tab, one end of which is affixed to a connection loop and the side surface of which is affixed to a hook fastener strip;

said main strap and said connection tab, which when adjustably connected by means of said connection loop and said length adjustment slide and also connected by said loop fastener strip and said hook fastener strip forrri said closed loop;

said loop fastener strip and said hook fastener strip, oriented such that said closed loop includes a one-half twist when said two fastener strips are engaged; and said specific novel path, wherein said closed loop extends down from a starting point under the strings and across the front surface of said instrument, across the lower side surface of said instrument at said narrowed waist, up across the back surface of said instrument, up the chest of said player and over the shoulder to the same side as said neck of said instrument, diagonally down across the back and forward under the opposite armpit of said player, across the upper side surface of the lower bout of said instrument, and returning across said front surface to said starting point under said strings.

* * * * *

UNITED STATES PATENT AND TRADEMARK OFFICE

CERTIFICATE OF CORRECTION

PATENT NO. : 8,975,498 B2
APPLICATION NO. : 13/972733
DATED : March 10, 2015
INVENTOR(S) : Timothy D. Mullins It is certified that error appears in the above-identified patent and that said Letters Patent is hereby corrected as shown below:

In the Claims

Column 4, line 43, the word “forrri” should read --form--.

Signed and Sealed this
Fifth Day of May, 2015

Michelle K. Lee

Michelle K. Lee
*Director of the United States Patent and Trademark Office*